United States Patent [19]

Pearl

[11] 4,328,726

[45] May 11, 1982

[54] APPARATUS AND METHOD FOR WORKING ON SUCCESSIVE SEGMENTS OF SHEET MATERIAL

[75] Inventor: David R. Pearl, West Hartford, Conn.

[73] Assignee: Gerber Garment Technology, Inc., South Windsor, Conn.

[21] Appl. No.: 207,873

[22] Filed: Nov. 18, 1980

Related U.S. Application Data

[63] Continuation of Ser. No. 8,045, Jan. 31, 1979, abandoned.

[51] Int. Cl.[3] ..... B26D 7/06; B65H 35/00

[52] U.S. Cl. ..... 83/39; 83/71; 83/217; 83/263; 83/734; 83/747; 83/925 CC; 33/1 M; 408/3; 409/80

[58] Field of Search ..... 83/13, 39, 56, 71, 152, 83/216, 217, 263, 747, 734, 925 CC; 408/3; 409/80; 33/1 M, 32 C, 35

[56] References Cited

FOREIGN PATENT DOCUMENTS 1382541 2/1975 United Kingdom .

*Primary Examiner*—James M. Meister

*Attorney, Agent, or Firm*—McCormick, Paulding & Huber

[57] ABSTRACT

Apparatus for cutting patterns from successive contiguous segments of an elongated layup of sheet material has a zoned vacuum table which includes an endless bristle mat conveyor, for shifting a layup along the table to position a segment of the layup in the cutting zone of the table and for holding the layup segment in the cutting zone, and a carriage assembly, which moves a cutting mechanism relative to the table and in cutting engagement with the segment to cut patterns from the segment in response to signals from a programmable controller. A rotary encoder mounted on the carriage assembly has a pinion which engages a rack carried by the conveyor to detect movement of the carriage assembly relative to the conveyor when the carriage assembly returns to its starting position after completing its cutting cycle. A responsive circuit connects the encoder to the conveyor drive motor and energizes the drive motor in response to the relative movement detected by the encoder to cause the conveyor to move the layup in the return direction and through a distance equal to the distance traversed by the carriage assembly in returning to its starting position whereby the next successive segment of the layup is accurately positioned in the cutting zone. An error sensing circuit detects the magnitude and direction of an error in positioning the layup and alters the data in the controller to nullify the error. A vacuum device cleans the bristle mat while the conveyor is in motion and also reduces the vacuum hold-down force applied to the layup while it is being shifted by the conveyor.

35 Claims, 14 Drawing Figures

APPARATUS AND METHOD FOR WORKING ON SUCCESSIVE SEGMENTS OF SHEET MATERIAL

This is a continuation, of application Ser. No. 8,045 Filed Jan. 31, 1979, now abandoned.

BACKGROUND OF THE INVENTION

This invention relates in general to apparatus for working on sheet material and deals more particularly with a method and apparatus for accurately shifting or indexing sheet material over the supporting surface of a work table.

Automatically controlled instrument systems having instrument carriages which move in two coordinate directions over a work surface of a table are well known. Typically, such a system includes a carriage assembly which has a first carriage supported to traverse the table in one coordinate direction parallel to the longitudinal axis of the work surface and a second carriage mounted on the first one and which moves relatively to the first one and in another coordinate direction. Composite movement of both carriages allows an instrument mounted on the second carriage to be translated to any point over a region of the supporting surface traversed by the carriage assembly. Accurate positioning of the carriages and, consequently, of the instrument is achieved by numerical controls which operate either from an on-line data generator or from previously programmed data. Automatically controlled machines of the aforedescribed type may be provided with a wide variety of instruments which may, for example, include plotting pens or styluses, lightheads, tracking heads and cutting or drilling tools. Such known systems have also been provided which include a conveyor or a separate drive mechanism for shifting sheet material along a table surface so that a long strip of material can be worked upon in segments. Such conveyors or drive mechanisms have also been employed for loading material onto or unloading material from the work table.

The difficulty of working upon successive contiguous segments of a strip of material is that indexing movement of a strip, unless precisely controlled, will not permit continuous patterns to extend between the contiguous segments of the strip. Although continuity between segments may not be important in some applications, in others it is critical. In cutting patterns from long layups of sheet material, for example, if the patterns in adjacent segments overlap, even by small amounts, the resulting cut parts may be unsuitable for use. Further, if adjacent patterns cut in successive segments are spaced an unnecessary distance apart material is wasted.

At least one system has been provided wherein the aforesaid problem is solved by directly coupling the sheet material to the carriage so that the sheet material is precisely shifted relative to the work table and in one direction with the carriage. Such apparatus is illustrated and described in U.S. Pat. No. 3,844,461 to Robinson et al for Precise Indexing Apparatus and Method, issued Oct. 29, 1974 and assigned to the assignee of the present application. While such indexing apparatus is quite suitable for light duty operation as, for example, shifting plotting paper in a high resolution plotting system where a series of lines may extend continuously over several successive segments of a strip which is longer than the plotting table, additional problems are encountered when such a system is used for a heavy duty operation, as for shifting a layup of heavy fabric or the like relative to a cutting table. Such heavy duty apparatus generally requires an additional shifting mechanism such as a conveyor or other material shifting device for moving the layup or allowing it to be moved relative to the table. Normally, a relatively light duty drive motor may be used in a fabric cutting apparatus to move the carriage assembly, which carries the cutting mechanism, relative to the table. However, if the fabric layup is coupled directly to the carriage assembly the latter assembly must apply pulling force to move both the layup and the shifting mechanism or conveyor which supports it and requires a relatively heavy duty drive mechanism. A further problem is encountered in positioning a layup where the layup is directly coupled to a carriage assembly due to the inertia of the heavy load which must be started and stopped by the carriage assembly. The present invention is primarily concerned with this problem.

In a layup cutting apparatus of the aforedescribed general type the cutting instrument generally must pass through the layup and penetrate the layup supporting surface. It is also generally desirable that some means be provided for compressing the layup and firmly holding it in fixed position on a supporting surface while it is cut, so that all patterns cut from the layup will be substantially identical. Heretofore, bristle mats have been utilized quite successfully to provide zoned vacuum holddown whereby holddown force may be applied to the material locally, that is in the region in which the cutting mechanism is operating. The present invention is further concerned with improvements in such zoned vacuum holddown tables.

When a vacuum holddown table having a surface defined by bristles is used to hold sheet material such as fabric, in a layup cutting apparatus, threads, lint and small pieces of scrap material tend to accumulate between the bristles and reduce the holddown efficiency of the table. The present invention is also directed to this problem.

SUMMARY OF THE INVENTION

The present invention resides in apparatus for working on successive segments of elongated sheet material and which includes a table, carriage means supported to move relative to the table for moving an instrument in working relation to a segment of sheet material spread on the table, first drive means for moving the carriage means in one and opposite first coordinate direction relative to the table, shifting means for moving the sheet material in the first coordinate direction and relative to the table, and second drive means for moving the shifting means. In accordance with the present invention, sensing means is provided for detecting movement of the carriage means in the first coordinate direction and relative to the sheet material during the material moving mode. Means responsive to the sensing means energizes the second drive means and causes the shifting means to move the material in the first coordinate direction relative to the table and through a distance equal to the distance traversed by the carriage means in the first coordinate direction during the material moving mode.

DETAILED DESCRIPTION OF PREFERRED EMBODIMENT

Figure 1:
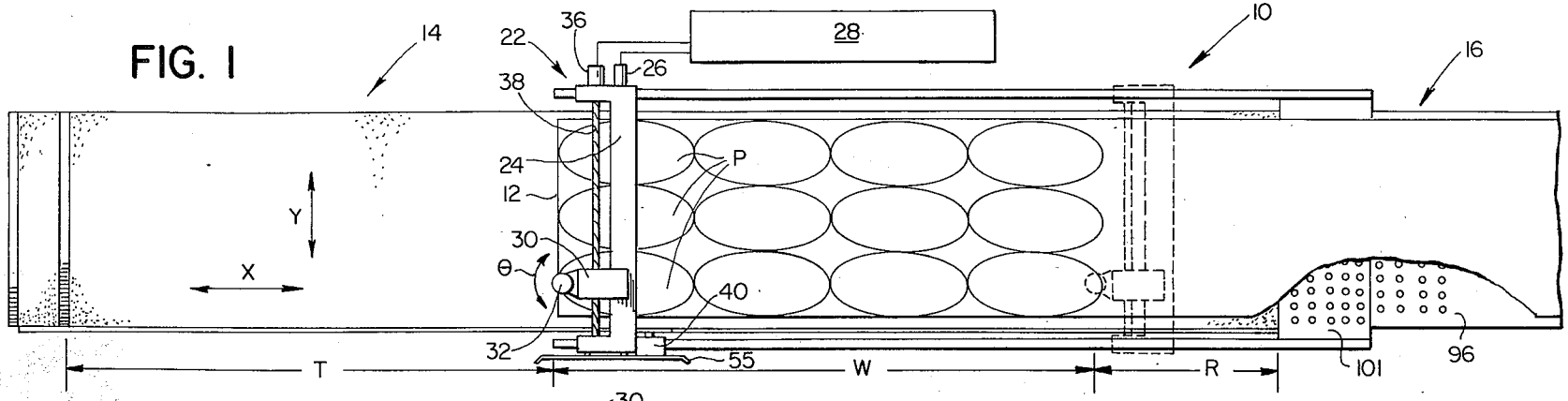
FIG. 1 is a plan view of an apparatus for cutting sheet material and embodying the present invention.
Figure 2:
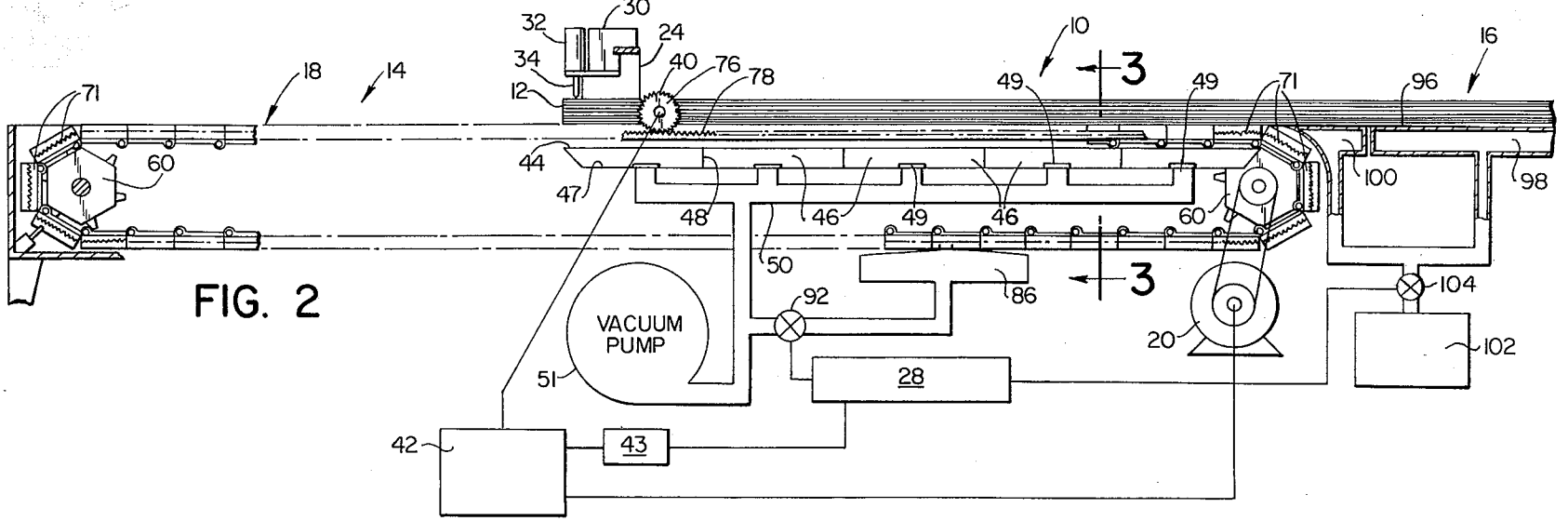
FIG. 2 is a somewhat schematic side elevational view of the machine of FIG. 1.

Turning now to the drawings, and referring particularly to FIGS. 1 and 2, an apparatus for working on sheet material and embodying the present invention is indicated generally by the reference numeral 10. The apparatus 10 is particularly adapted for cutting patterns P, P from successive segments of a long layup of sheet material, such as indicated at 12, and includes a working or cutting table indicated generally at 14 and a layup table designated generally by the numeral 16. The layup 12, which comprises a plurality of sheets of limp fabric or the like, has a length substantially greater than the length of the cutting table 14 and extends from the layup table 16 onto the cutting table 14. The cutting table 14 includes a conveyor indicated generally at 18 and driven by a motor 20 for shifting the layup 12 relative to the cutting table so that it can be worked upon in segments. The conveyor 18 is also employed for loading and unloading the cutting table 14, all of which will be hereinafter further discussed.

A carriage assembly indicated generally at 22, which comprises a part of the apparatus 10, has a first carriage 24 supported to move longitudinally of the cutting table 14 in one or an opposite (X) coordinate direction and driven by a motor 26 which receives drive signals from a programmable controller or computer 28. A second carriage 30 mounted on the first carriage 24 moves with it and carries a cutting mechanism 32 which includes an instrument or blade 34. The second carriage 30 is supported to move in one and an opposite transverse (Y) coordinate direction on the first carriage and relative to the table 14. A drive motor 36 mounted on the first carriage 24 rotates a lead screw 38 in either a clockwise or counterclockwise direction in response to signals from the controller 28 to drive the second carriage 30 in one or the other (Y) coordinate direction. The vertically reciprocally movable blade 34 is preferably arranged to rotate in either direction about its vertical axis, as indicated by the coordinate $\theta$, in response to signals from the controller 28. Thus, the blade 34 is supported for composite movement in X, Y and $\theta$ coordinate directions and in cutting engagement with the layup 12 in response to signals from the controller 28. The apparatus 10 has a working mode during which the blade 34 is moved by the carriage assembly 22 in cutting engagement with the layup 12 and a material moving mode during which the blade 34 is out of working relation with the layup 12. During the material moving mode the carriage assembly returns in the X-coordinate direction to its initial starting position relative to the table 14 and the conveyor 18 advances the next segment of the layup to cutting position on the table.

In accordance with the invention, a sensing device, indicated at 40, is provided for detecting movement of the carriage assembly 22 in the X-coordinate direction and relative to the layup 12 during the material moving mode. Responsive means, indicated generally at 42 and connected to the sensing device 40 and to the drive motor 20 energizes the drive motor 20 in response to relative movement detected by the sensing means to cause the conveyor 18 to shift the layup 12 in the X-coordinate direction relative to the table 14 and through a distance equal to the distance traversed by the carriage assembly 22 in the X-coordinate direction in returning to its initial starting position, that is its position at the start of the cutting cycle. The apparatus further includes an error sensing means, indicated generally at 43, for detecting the magnitude and direction of error in positioning the layup and for nollifying the error as will be hereinafter more fully discussed.

Considering now the apparatus 10 in further detail and referring further to FIGS. 3–7, the illustrated cutting table 14 comprises a zoned vacuum holddown table and has a material receiving region at one end generally adjacent an associated end of the layup table 16 and designated generally by the letter R, a working region designated generally by the letter W, and a takeoff region at its other end indicated by the letter T, as shown in FIG. 1. A typical cutting table may, for example, be approximately 6 feet wide and 36 feet long. Preferably, the region R is 6 feet long whereas the regions T and W are each 15 feet in length. The table 14 has a horizontally disposed surface plate 44. A series of longitudinally spaced apart rows of holes 45, 45 are formed in the plate, each row being longitudinally spaced 8 inches from the next successive row. A longitudinal series of vacuum chambers 46, 46 are located below and partially defined by the surface plate 44 and extend throughout the working region W and through at least a portion of the material receiving region R. The chambers 46, 46 are further defined by a bottom plate 47 spaced below the surface plate 44 and longitudinally spaced series of partitions or air barriers 48, 48 which extend transversely of the table between the surface plate 44 and the bottom plate 47. The partitions 48, 48 are preferably longitudinally spaced 24 inches apart and separate each chamber 46 from the next successive chamber in the series. A longitudinally spaced series of vacuum ports 49, 49, on 24 inch centers, open through the bottom plate 47. Each vacuum port communicates with an associated one of the vacuum chambers and with a common vacuum duct 50 connected to a vacuum pump 51 substantially as shown in FIG. 2. A plurality of slide valves 52, 52 are supported adjacent the upper surface of the bottom plate 47. Each slide valve has a hole 53 therethrough, is located within an associated chamber 46, and is movable between closed and open positions respectively indicated in full and broken lines in FIG. 7. In the open position the hole 53 is in registry with its associated port 49. In the closed position the valve 52 covers the port. Each valve 52 is normally biased to its closed position and carries a roller follower 54 which extends into the path of a cam 55 mounted on the carriage assembly 22. Movement of the carriage assembly in the X-coordinate direction sequentially operates the slide valves 52, 52 associated with the successive chambers 46, 46.

Figure 3:
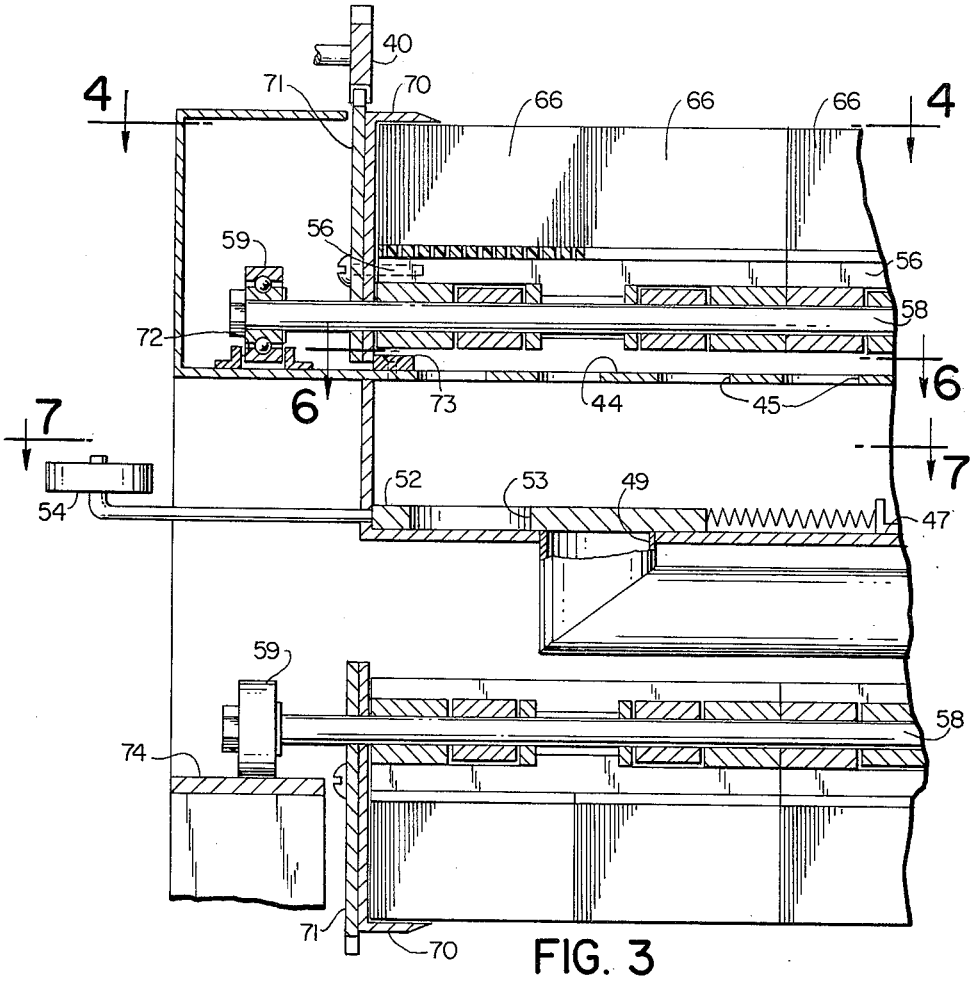
FIG. 3 is a somewhat enlarged fragmentary sectional view taken along the line 3—3 of FIG. 2.
Figure 5:
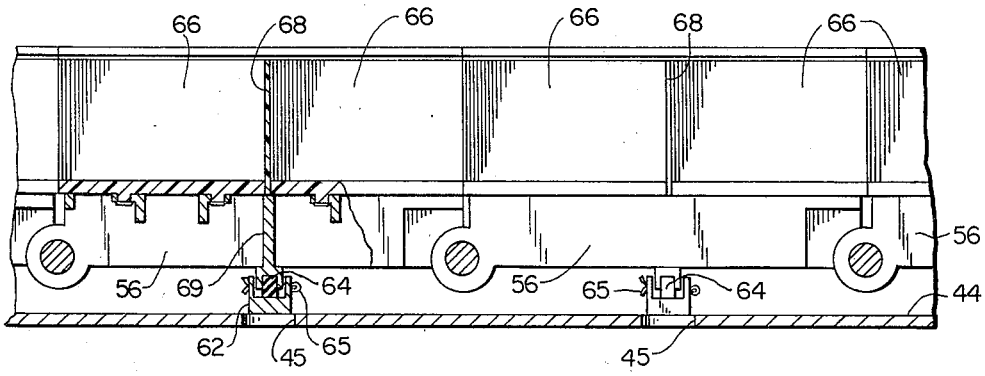
FIG. 5 is a fragmentary sectional view taken along the line 5—5 of FIG. 4.
Figure 6:
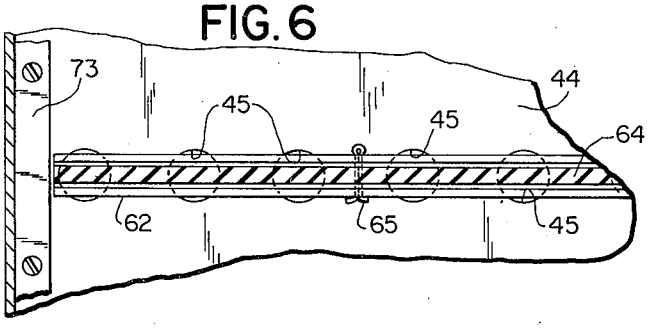
FIG. 6 is a fragmentary sectional view taken along the line 6—6 of FIG. 3.

The conveyor 18 encircles a portion of the table which includes the surface plate 44 and the vacuum chambers 46, 46 and comprises an endless belt of articulated grid sections 56, 56 connected in linking relation by connecting pins 58, 58 which extend through grid sections and transversely of the table 14. More specifically, the conveyor 18 is formed from transverse rows of grid sections 56, 56, the grid sections in each row being arranged in side-by-side relation to each other and connected to the grid sections of adjacent rows by connecting pins 58, 58 on 8 inch centers. Each connecting pin 58 has a pair of rollers 59, 59 mounted at its opposite ends, as illustrated in FIG. 3, where one rod end is shown. The endless belt formed by the linked grid sections is supported by two transversely spaced series of star wheels 60, 60 journalled at opposite ends of the cutting table and formed with cogs which engage the grid sections, as shown somewhat schematically in FIG. 2. Each row of grid sections carries a transversely extending sealing member 62 which is preferably made from low friction plastic material and which has a flat surface for slidably engaging the upper surface of the surface plate 44. Each sealing member has an elongated transversely extending channel which receives a resilient member 64 associated with the row of grid sections which carry it. Pins 65, 65 extend through the grid sections and through slots in each sealing member 62 to retain the sealing member in assembly with the grid section for limited movement relative thereto, substantially as shown in FIG. 5. Each resilient member 64 tends to bias an associated sealing member 62 toward engagement with the surface plate 44 as the sealing member travels in sliding engagement with the surface plate to assure relatively tight sealing engagement between the various sealing members and the surface plate. Each sealing member 62 extends across the surface plate 44 and is movable into partially covering relation with an associated row of holes 45, 45. The transversely extending sealing members 62, 62 are longitudinally spaced eight inches apart as are the transversely extending rows of holes 45, 45. However, it should be noted that the diameter of each hole 45 is slightly greater than the width of a sealing member 62 so that the conveyor 18 cannot attain a position relative to the surface plate 44 wherein all of the holes 45, 45 are simultaneously tightly sealed by sealing members 62, 62.

Figure 4:
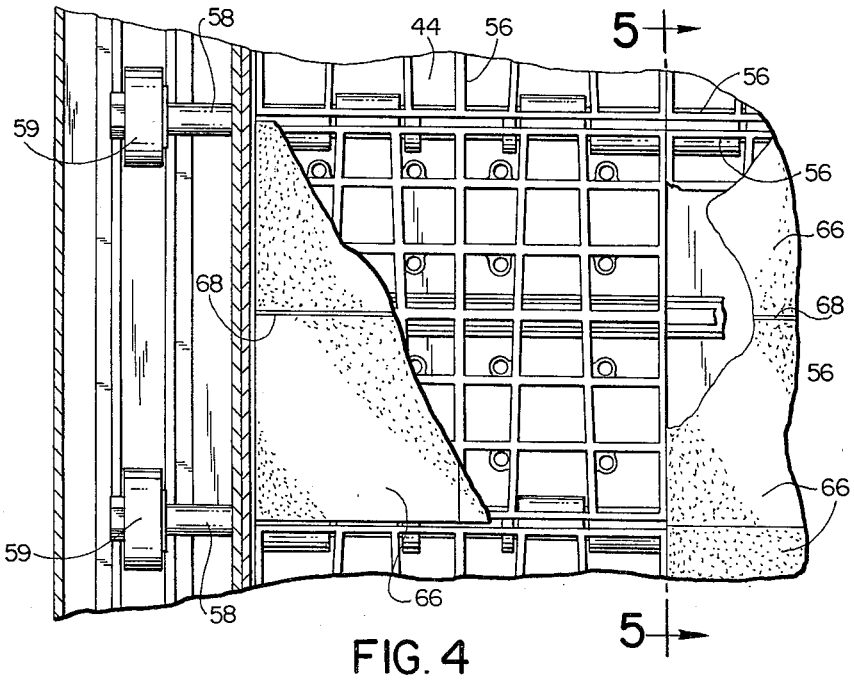
FIG. 4 is a somewhat enlarged fragmentary sectional view taken along the line 4—4 of FIG. 3.

Preferably and as shown each grid section 56 carries four bristle blocks 66, 66. Each bristle block is preferably molded from plastic material and includes a perforated base and a plurality of bristles integrally connected to and projecting from the base. The perforations in the base of each bristle block communicate with apertures in the grid section 56 upon which the bristle block is mounted, as best shown in FIGS. 4 and 5. A transversely extending partition 68, made from plastic material or the like, is disposed between each pair of longitudinally adjacent bristle blocks 66, 66 which are connected in fixed position to each grid section. The latter partition is vertically aligned with a transversely extending rib 69 of the grid section and with an associated sealing member 62 carried by the grid section, substantially as shown in FIG. 5, and cooperates with the rib and the sealing member to define a transversely disposed air barrier.

The bristle blocks 66, 66 are arranged with the free ends of the bristles disposed in a common plane so that the various bristle blocks which comprise the conveyor 18 cooperate with each other to form a movable perforated bristle mat. The upper run of the bristle mat defines a substantially horizontally disposed and upwardly facing material supporting surface for supporting the layup 12.

Each of the outermost grid sections at the longitudinally extending sides of the conveyor carries an inverted generally L-shaped side plate 70 made from rubber or like material, (one shown in FIG. 3). Each side plate is disposed adjacent bristles and extends inwardly for some distance adjacent the surface defined by the free upper ends of the bristles. The lower marginal edge of each side plate 70, as it appears in FIG. 3, is disposed in sealing relation adjacent a metal strip 73 which is fastened to and extends longitudinally of the upper surface of the surface plate 44. A rack plate 71 is mounted outwardly of and adjacent each side plate, substantially as shown in FIG. 3, and has gear teeth thereon. The upper run of the conveyor belt 18 is supported by the sealing members 62, 62 which move in sliding engagement with the surface plate 44. The rollers 59, 59 associated with the upper run of the conveyor belt 18 are received in shallow ways 72, 72 (one shown in FIG. 3) and serve only as truss members to maintain the conveyor belt in proper tracking relation with the table 14. However, the rollers 59, 59 associated with the lower run of the conveyor belt roll on ways 74, 74 (one shown), carry the weight of the lower run, and prevent the conveyor belt from sagging, thereby reducing its resistance to movement relative to the cutting table 14.

Figures 10, 11, 12:
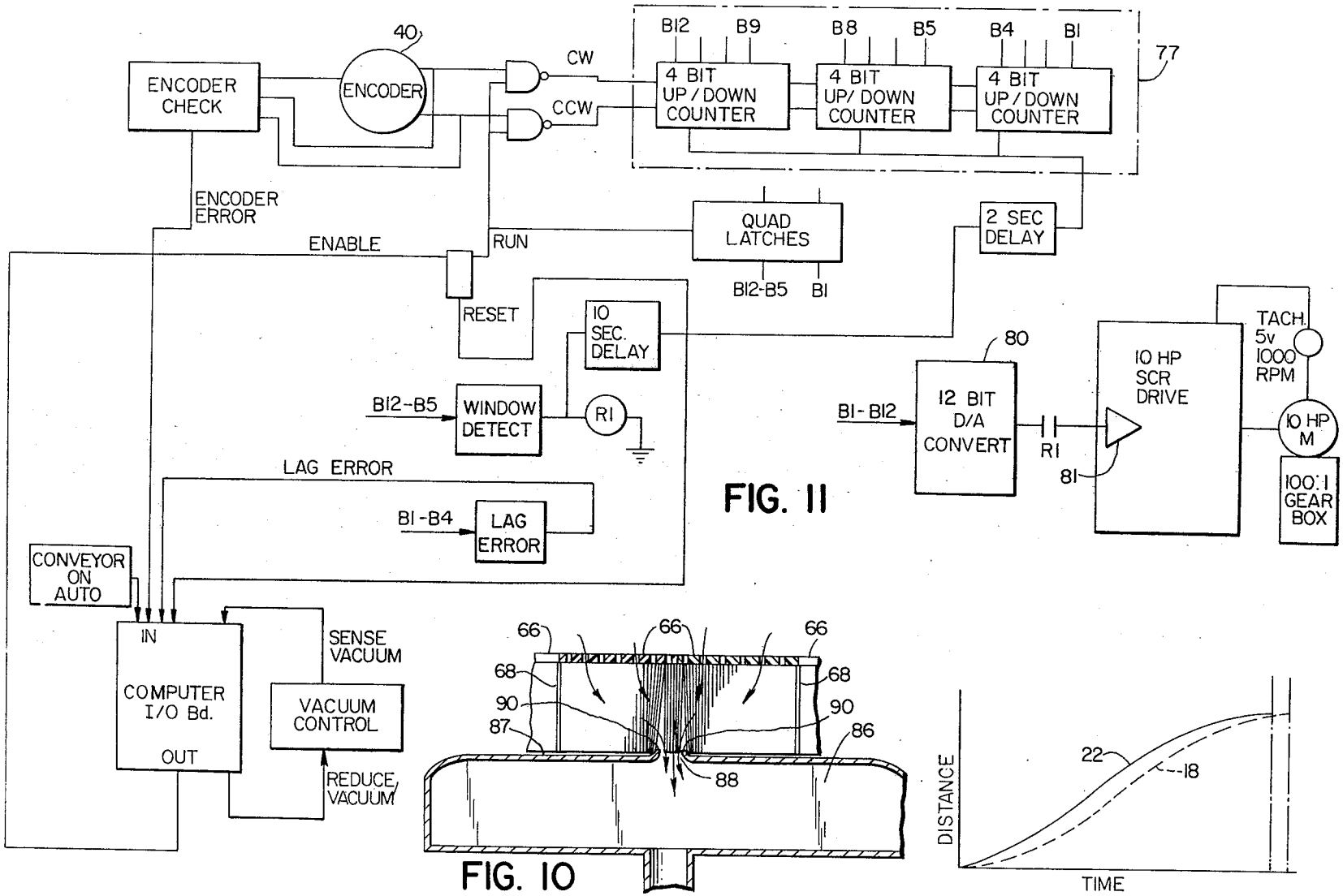
FIG. 10 is a somewhat enlarged fragmentary side elevational view of a part of the bristle mat cleaning device.
FIG. 11 is a circuit diagram and illustrates a circuit for controlling the sheet material positioning mechanism.
FIG. 12 graphically illustrates the operation of the sheet material positioning mechanism.

The illustrated sensing device 40 comprises a rotary encoder which is mounted on the carriage 22 and has a pinion 76 engaged with a longitudinally extending rack 78 formed by the rack plates 71, 71. The presently preferred encoder comprises a model 39/39 EM Optical Shaft Angle Encoder marketed by Dynamics Research Corporation, Wilmington, Mass. The encoder is arranged to detect the direction of shaft rotation and is coupled to a motor 20 through an up-down counter 77, a digital/analog converter 80, and a power amplifier 81, which collectively comprise the responsive means 42, substantially as shown in FIG. 11. It should be understood, however, that numerous electronic circuits are capable of the required control and are not themselves a part of this invention. What is required is a means for measuring movement of the carriage assembly in the X-coordinate direction and relative to the conveyor 18 in returning to its starting position upon completion of the cutting cycle and for causing the conveyor to move relative to the surface plate 44 through a distance substantially equal to the measured distance traversed by the carriage assembly 22 in returning to its origin or starting position.

In accordance with the invention, movement of the conveyor 18 to advance a segment of the layup is controlled by the carriage during the material moving mode. Slight error may occur in positioning the layup segment, due to the inertial mass of the conveyor and the layup carried by it. This position error will result in an accumulation of encoder pulses in the register or up-down counter 77 representative of a plus or minus distance in the X-coordinate direction. The error sensing circuit 43 detects and stores the error which is then fed to the controller where it is used to shift the origin of the absolute data for the next pieces to be cut. The controller then outputs a signal to the first carriage drive motor causing the carriage to move in an X-coordinate direction and through the distance required to nullify the error. Thus, by moving the lighter carriage assembly to nullify the error, the blade 34 may be accurately positioned at its origin relative to the next layup segment to be cut.

Figure 7:
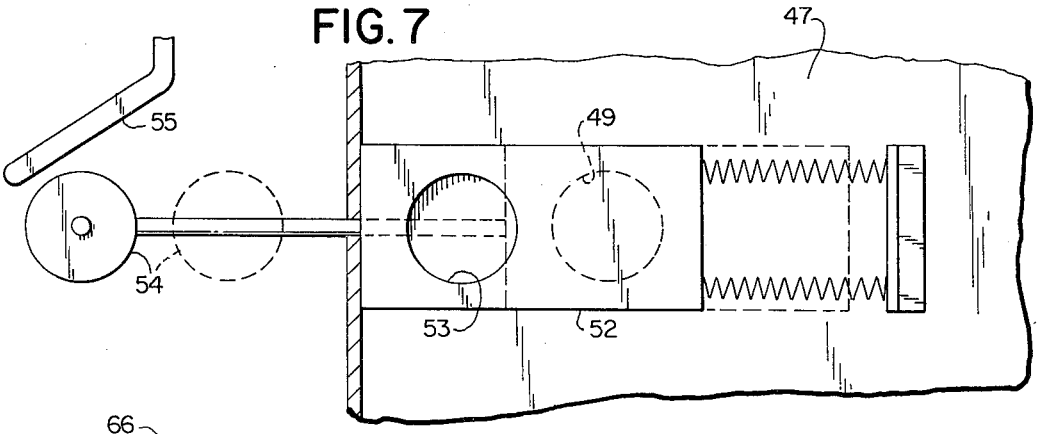
FIG. 7 is a fragmentary sectional view taken along the line 7—7 of FIG. 3.
Figure 8:
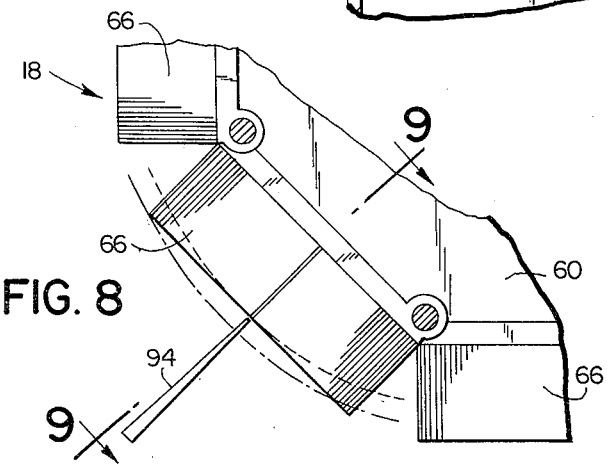
FIG. 8 is a somewhat enlarged elevational view of a portion of one end of the apparatus of FIG. 1.
Figure 9:
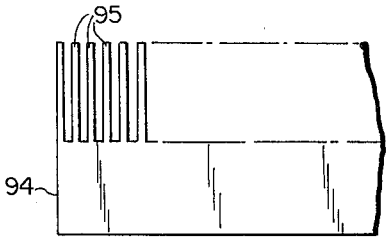
FIG. 9 is a fragmentary sectional view taken generally along the line 9—9 of FIG. 8.

The apparatus 10 further includes a device for cleaning the bristle mat, to remove lint, threads or scrap material which may become logged between the bristles, and comprises a plenum chamber 86 disposed below and generally adjacent the lower surface of the lower run of the belt conveyor 18. The chamber 86 is defined in part by a plate 87 which has a horizontally elongated upper surface. An opening or narrow slot 88 in the plate 87 is disposed generally adjacent the lower surface of the conveyor bristle mat. The slot 88 extends transversely of the bristle mat and is defined by at least one upwardly projecting lip 90 on the plate 87 which extends into the path of the free ends of the bristles and which is adapted to riffle the bristles for a purpose which will be hereinafter further evident. The plenum chamber 86 is connected to the vacuum pump 51 through a valve 92 which operates in timed relation to the cutting table cycle and in response to signals from the controller 28. The bristle cleaning device further includes a rake 94 positioned at the take-off end of the cutting table and extending transversely of the conveyor 18. The rake 94 has a multiplicity of transversely spaced apart teeth 95, 95, as shown in FIG. 9, and is positioned to rake an arcuate path through each bristle block as the block travels downwardly over the star wheels 60, 60 through its return path, so as to avoid contact with the partition associated with each pair of adjacently mounted bristle blocks, substantially as shown in FIG. 7, wherein paths of the rake through two adjacent bristle blocks, mounted on a grid section 56, are indicated by broken lines.

The layup table 16 comprises an air bearing table and has an upper surface formed by a perforated plate 96. An air chamber 98 immediately below the plate 96 communicates with the perforations in the plate. Another air chamber 100 is partially defined by a horizontally disposed perforated bridge plate 101 which bridges the gap between the conveyor 18 and the layup table 16. The air chambers 98 and 100 are connected to a source of air under pressure 102, which may, for example, comprise the receiver tank of an air compressor. A valve 104 connected between the air source 102 and the air chambers 98 and 100 is operated by the controller 28 to supply air to the air chambers in timed relation to the operating cycle of the cutting table 14.

Considering now the operation of the apparatus 10, the material to be cut may be laid up on a sheet of perforated kraft paper spread on the layup table 16 to reduce friction between the layup and the table surface. If the material to be cut is porous the layup may be covered with a sheet of substantially air impervious material, in accordance with conventional practice for cutting such material on a vacuum holddown table.

The leading segment or bite of the layup is moved from the layup table 16 onto the cutting table 14 and to a predetermined position within the region W and relative to the blade 34, the blade being positioned in its origin or starting position at the commencement of a cut, as determined by absolute program data in the computer 28. Manual override controls (not shown) may be provided to bypass the computer, so that air may be applied to the layup table 16 and the bridge plate 101, vacuum may be applied to the bristle mat, and the conveyor 18 may be operated to manually advance the layup, as required to properly position the leading segment of the layup in the zone W. An indicator, such as a light source carried by the cutting mechanism 32 and directed toward the table may, for example, be used to position a point of reference, such as a corner of the layup, relative to the cutting mechanism.

When a segment or bite of the layup is properly positioned in relation to the cutting mechanism 32 in its origin position, as it appears in full lines in FIG. 1, the apparatus 10 is ready for controlled operation to automatically cut patterns P, P from the segment in accordance with a predetermined cutting program and to advance the next successive segment or bite to cutting position on the table 14 when the preceding segment has been cut.

During the cutting mode, the conveyor 18 remains at rest and the valve 92 is in closed position so that maximum available vacuum is applied to the surface of the bristle mat, at least in the region where the cutting mechanism 32 is operating. The layup 12 is held in position on the cutting table and compressed by applied vacuum to assure accurate cutting, as is well known in the art. The blade 34 now advances in working relation to the layup 12 to cut patterns P, P from the segment in the region W in accordance with the predetermined cutting program. The apparatus 10 is preferably programmed so that the cutting mechanism 32 may advance from the region W into the region R in cutting relation with the layup to complete any pattern or patterns which may start in the region W and extend into the region R. Thus, a plurality of complete patterns P, P are cut from the layup 12. The controller may also be programmed to cut the scrap material during the cutting mode whereby to separate the scrap into individual piles for convenience in further handling. Upon completion of the cutting mode the carriage assembly 22 will be in a position such as indicated in broken lines in FIG. 1, from which position the apparatus 10 enters its material moving mode.

At the start of the material moving mode a signal from the computer 28 opens the valve 92 to lower vacuum applied to the table 14 by the pump 51. By lowering the vacuum applied to the layup during the material moving mode, the force exerted by the layup and the conveyor upon the surface plate 44 is substantially reduced thereby reducing frictional engagement between the sealing bars 62, 62 and the surface plate 44. However, sufficient vacuum is maintained to prevent slippage or relative movement between the surface of the bristle mat and the layup which it carries.

When the table vacuum is lowered to a preset value, as indicated by a low vacuum sensor, the computer activates the responsive means or bite feed servo control logic 42 by means of an enable signal thereby causing the carriage assembly 22 to return in the X-coordinate direction from its broken line position toward its full line position of FIG. 1.

Referring now particularly to FIG. 11, initial return movement of the carriage assembly 22 relative to the conveyor 18 causes the encoder shaft to turn in a clockwise direction, thereby causing the twelve bit counters to count up, which in turn results in a positive voltage output from the D/A converter whereby the conveyor drive motor 20 is energized to drive the conveyor 18 in the same direction as the carriage assembly 22. The conveyor 18 moves slowly at first, but ultimately attains a constant speed of approximately 0.5 feet per second. As the carriage assembly 22 moves the conveyor 18 follows it at a speed which is close to the speed of the carriage assembly. The encoder output corresponds to the relative positional difference (lag) between the moving carriage assembly and the moving conveyor. This condition is graphically illustrated in FIG. 12, wherein the relative positions of the carriage assembly 22 and the cutting table conveyor 18 are plotted against time. When the carriage assembly reaches its position of origin it stops moving, under computer control, however, the conveyor 18 continues to move in response to voltage output from the converter. The lag error decreases as the encoder changes direction and outputs pulses on the counterclockwise channel which, in turn, starts to count down the twelve bit counters.

When the counter approaches a specified value which may, for example, correspond to a ½ inch positional error between the conveyor and the carriage assembly, the window detect circuit will bring in relay $R_1$ which turns off the D/A converter output voltage to the conveyor drive motor 20. After the short delay time (10 seconds) the computer will read the remaining error count, as shown in the quad latches. This remaining error, which represents either plus or minus the distance will be used to shift the origin of the absolute data for the next group of pieces to be cut from the next successive bite of the layup 12. The carriage assembly 22 will then position the cutter mechanism 32 in the new origin position in response to output signal from the computer 28. The computer will next issue a high vacuum signal to the vacuum control circuit to close the valve 92 whereupon the cutting mode is resumed.

Figure 14:
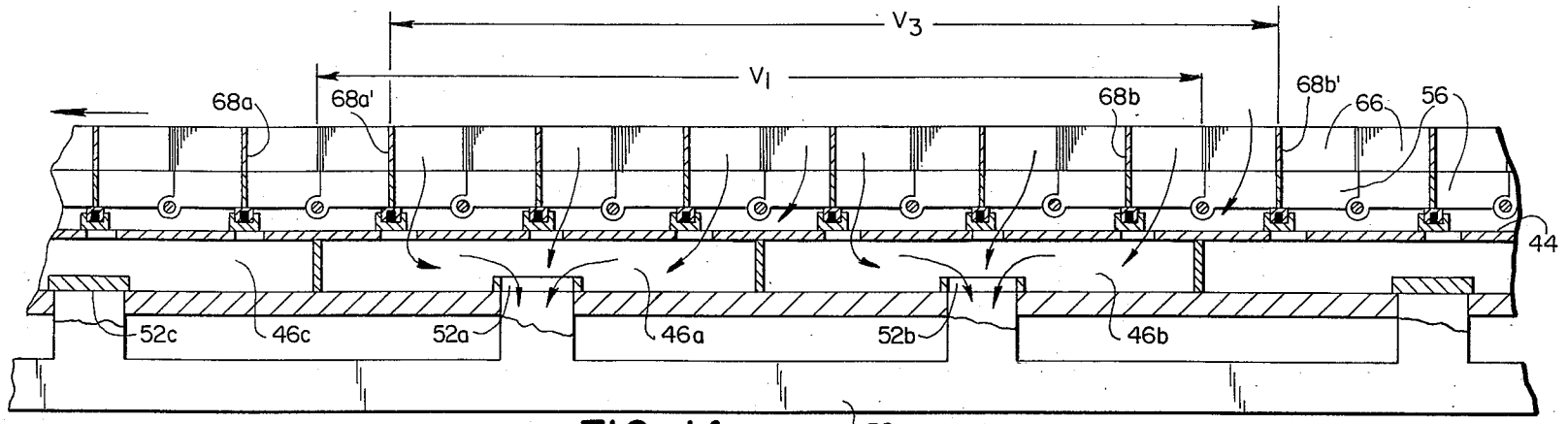
FIG. 14 is similar to FIG. 13 but shows the cutting table conveyor in another position.
Figure 13:
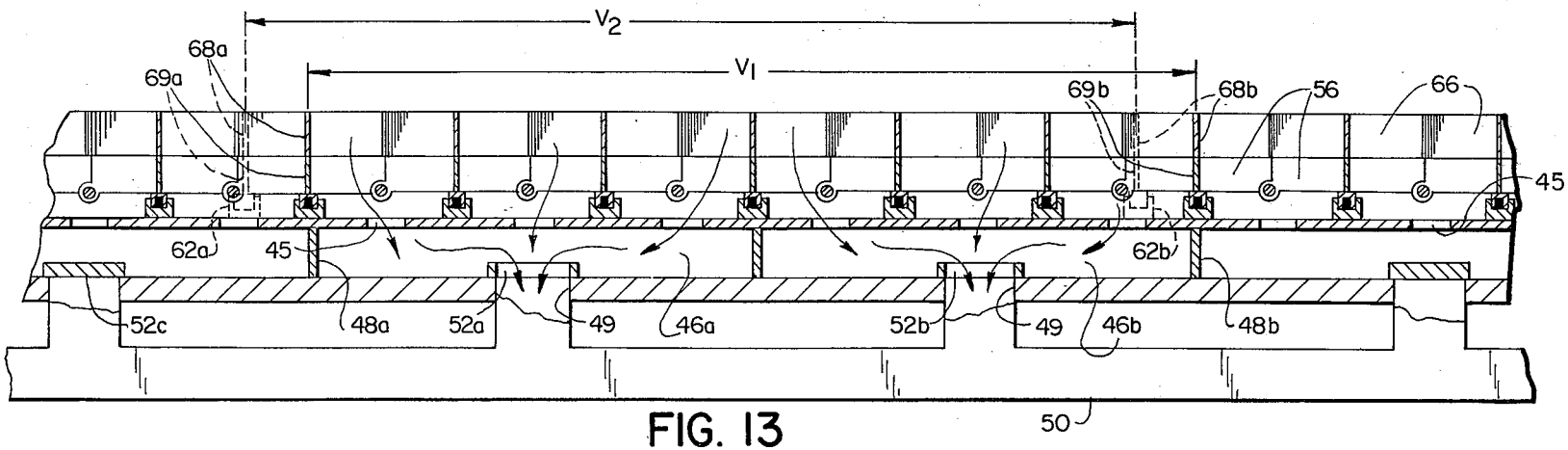
FIG. 13 is a somewhat enlarged schematic side elevational view of a portion of the zones cutting table of FIG. 1.

As the carriage assembly moves longitudinally of the table 14 during the material moving mode the cam 55 which operates the slide valves 52, 52 maintains at least one and preferably two of the slide valves in open position so that vacuum is simultaneously applied to two adjacent vacuum chambers. Referring now particularly to FIGS. 13 and 14 where, for convenience in describing the operation of the zoned vacuum conveyor, two adjacent vacuum chambers are designated 46*a* and 46*b*. Referring first to FIG. 13, when the conveyor 18 is in its full line position and that slide valves 52*a* and 52*b* are held in open position by the cam 55, and vacuum is applied to the upper surface of the bristle mat in the zone which is designated $V_1$ and which extends longitudinally between the transverse partitions 68*a* and 68*b*. More specifically, air is drawn down through the surface of the bristle mat through the perforated bases of the bristle blocks 66, 66 which comprise the mat, through the openings in the grid sections 56, 56 which support it and through the various holes 45, 45 and into the chambers 46*a* and 46*b* and through the open slide valves 52*a* and 52*b* into the vacuum duct 50, as generally indicated by flow arrows in FIG. 13. The partitions 68*a* and 68*b* and the ribs 69*a* and 69*b* are respectively vertically aligned with the air barriers 48*a* and 48*b* so that the region $V_1$ is located immediately above the vacuum chambers 46*a* and 46*b*. As the conveyor 18 travels in the return direction indicated by the directinal arrow in FIG. 14, the partitions indicated at 68*a* and 68*b* advance to the broken line positions shown, wherein sealing members 62*a* and 62*b* move into closing relation with associated holes 45, 45 substantially as shown. The partitions 68*a* and 68*b* continue to define the longitudinal extent of the vacuum zone, however, it will be noted that the zone has migrated approximately 4 inches in the direction of conveyor travel from the position indicated at $V_1$ to a new position indicated at $V_2$ in FIG. 13.

Referring now to FIG. 14, when the partitions 68*a* and 68*b* advance to the full line positions shown, control of the vacuum zone defined by the bristle mat abruptly passes from the partitions 68*a* and 69*b* (FIG. 13) to the next successive set of partitions indicated at 68*a'* and 68*b'* in FIG. 14. Thus, the vacuum zone shifts abruptly in a direction opposite the direction of conveyor travel and from the position indicated at $V_2$ in FIG. 13 to the position designated $V_3$ in FIG. 14, and through a distance of approximately 8 inches. The vacuum zone then migrates from its position $V_3$ of FIG. 14 to its position $V_2$ of FIG. 13 as the conveyor continues to advance. This abrupt rearward shift and forward migration of the vacuum zone continues until the cam 55 carried by the advancing carriage assembly 22 allows the slide valve 52*b* to close and opens the next successive slide valve designated 52*c*, whereupon control of the longitudinal position of the vacuum zone shifts to the adjacent vacuum chambers 46*a* and 46*c*. When the apparatus enters its cutting mode the operator may separate, bundle, and remove the cut patterns and piles of scrap material from the take-off region T. However, if desired, a suitable take-off conveyor (not shown) may be provided adjacent the take-off end of the cutting conveyor to receive the cut material and move it to a further work station.

The mat cleaning apparatus which includes the rake 94 and the plenum chamber 86 operates during the material moving mode. The rake 94 combs each successive bristle block 66 to remove large pieces of cut scrap and threads from the bristle mat.

Referring particularly to FIG. 10, as a portion of the bristle mat travels across the upper surface of the plate 87 the lips 90, 90 which define the slot 88 riffle the bristles to loosen debris. Adjacent partitions 68, 68 in the bristle mat cooperate with the upper surface of the plate to seal an area of the mat so that air is drawn downwardly through holes in the base of the bristle mat and toward the slot 88. Local high velocity air flows along the length of bristles in the vicinity of the slot 88 and cleans them. The plenum chamber 86 which is shown somewhat schematically may, of course, be provided with a suitable access opening for removing lint, fine scrap material and other debris which accumulates therein. Thus, the clearning apparatus performs the dual function of both claiming the bristle mat and reducing the vacuum applied to the vacuum table during the material moving mode, as hereinbefore discussed.

I claim:

1. In an apparatus for working on sheet material and having a working table, instrument means for working on sheet material, carriage means supported to move in a first coordinate direction relative to the table for moving the instrument means in working relation to sheet material spread on the table, first drive means for moving the carriage means in the first coordinate direction, means for controlling said first drive means to control movement of said carriage means, material shifting means for moving the sheet material relative to the table and in the first coordinate direction, and second drive means for moving the material shifting means, the apparatus having a working mode wherein said carriage means moves in said first coordinate direction from a position of origin relative to the table and the material spread thereon in response to signals from the control means to move the instrument in working relation to the material and a material moving mode wherein the instrument is out of working relation to the sheet material and the material shifting means moves the sheet material in the first coordinate direction relative to the table, the improvement comprising a rotary encoder coupled to said carriage means and to said material shifting means for detecting movement of said carriage means in said first coordinate direction relative to said material shifting means in returning toward said position of origin upon completion of said working mode and responsive means connecting said rotary encoder to said second drive means for energizing said second drive means in response to the detected movement of said carriage means relative to the material shifting means to cause said material shifting means to move in said first coordinate direction and to a predetermined position.

2. In an apparatus for working on sheet material as set forth in claim 1 the further improvement wherein said second drive means is arranged to move said material shifting means in said first coordinate direction and through a distance substantially equal to the distance traversed by said carriage means in returning toward said position of origin in response to said detected movement.

3. In an apparatus as set forth in claim 1 the further improvement wherein said material shifting means comprises a conveyor which forms a part of the table and defines a surface of the table and said encoder includes a rotary part engaged with said conveyor.

4. In an apparatus as set forth in claim 3 the further improvement wherein said conveyor has a rack thereon and said rotary part comprises a pinion engaged with said rack.

5. In an apparatus for working on sheet material as set forth in claim 1 the further improvement wherein said rotary encoder comprises an incremental encoder and said responsive means includes a counter receiving output signals from said incremental encoder.

6. In an apparatus for working on sheet material as set forth in claim 5 the further improvement wherein said rotary encoder comprises a shaft angle encoder having two count channels and responsive to the direction of shaft rotation and said counter comprises an up/down counter.

7. In an apparatus for working on sheet material as set forth in either claim 1 or claim 6 the further improvement wherein said apparatus includes means for detecting error in the position of the material shifting means when the material shifting means fails to attain said predetermined position upon completion of said material moving mode and means responsive to said positional error detecting means for moving said carriage means relative to said sheet material shifting means to nullify said positional error.

8. In an apparatus for working on sheet material as set forth in claim 5 the further improvement wherein said controller comprises a computer having data controlling said first drive means to position said carriage means and said apparatus includes means for detecting error in the position of the material shifting means when the material shifting means fails to attain said predetermined position upon completion of said material moving mode, said error detecting means including means for disconnecting said counter from said second drive means when said material shifting means has traversed a predetermined distance in said one coordinate direction during said material moving mode, signal storage means for receiving and accumulating output signals from said counter after said counter has been disconnected from said second drive means, and means for connecting the signal storage means to said computer to modify said data stored in said computer in response to output signal from said signal storage means.

9. In an apparatus for working on sheet material as set forth in claim 1 the further improvement wherein said material shifting means comprises a movable bristle mat which forms a part of said table and has upwardly extending bristles defining a sheet material supporting surface.

10. In an apparatus for working on sheet material as set forth in claim 11 the further improvement wherein said material shifting means comprises an endless belt conveyor which includes said bristle mat.

11. In an apparatus for working on sheet material as set forth in either claim 9 or claim 10 the further improvement wherein said table comprises a vacuum table, said sheet material supporting surface has air passages therethrough, and said apparatus includes vacuum producing means and means providing communication between said vacuum producing means and at least some of said air passages to provide vacuum adjacent at least one region of said sheet material supporting surface.

12. In an apparatus for working on sheet material as set forth in claim 11 the further improvement which comprises means for reducing the vacuum adjacent said one region of said sheet material supporting surface during said material moving mode.

13. In an apparatus for working on sheet material as set forth in claim 12 the further improvement wherein said vacuum reducing means comprises means for cleaning said bristle mat.

14. In an apparatus for working on sheet material as set forth in claim 13 wherein said cleaning means comprises means defining a vaccum chamber having an opening therein adjacent another portion of said mat and means providing communication between said vacuum chamber and said vacuum producing means during said material moving mode.

15. In an apparatus for working on sheet material as set forth in claim 1 wherein said table comprises a vacuum table the further improvement wherein said material shifting means comprises a part of said table and defines a movable material supporting surface thereof having air passages therethrough and said apparatus further includes vacuum producing means and means for connecting said vacuum producing means in communication with at least one region of said material supporting surface to apply vacuum to said supporting surface in said one region.

16. In an apparatus for working on sheet material as set forth in claim 15 the further improvement wherein said one region comprises a longitudinal series of contiguous material supporting zones and said connecting means is further characterized as means for connecting said vacuum source to and disconnecting it from successive zones of said supporting surface in response to movement of said instrument relative to said table.

17. In an apparatus for working on sheet material as set forth in either claim 15 or claim 16 the further improvement wherein said material shifting means comprises an endless belt conveyor which has a bristle mat defining said material supporting surface.

18. In an apparatus for working on sheet material as set forth in claim 1 the further improvement wherein the material shifting means comprises an endless belt of bristles which forms a part of the table and includes an upper run having upwardly extending bristles defining a sheet material supporting surface and a lower run having downwardly extending bristles defining a lower surface of said belt and said apparatus includes a vacuum chamber below said belt and having an opening therein adjacent said lower surface and means for drawing air from said vacuum chamber to draw air downwardly from said belt and through said opening.

19. In an apparatus for working on sheet material as set forth in claim 18 the further improvement wherein said opening comprises a slot extending transversely of the direction of belt travel.

20. In an apparatus for working on sheet material as set forth in claim 19 the further improvement wherein said slot is defined by at least one lip extending into the path of bristle travel for deflecting engagement with free end portions of said bristles.

21. In an apparatus for working on sheet material as set forth in claim 18 the further improvement wherein said apparatus includes a rake extending transversely of the direction of belt travel and having a marginal portion disposed in the path of travel of the free ends of said bristles.

22. In an apparatus for working on sheet material as set forth in claim 21 the further improvement wherein said rake is disposed adjacent an arcuate portion of said belt to rake an arcuate path through said bristles.

23. A method for precisely positioning sheet material in an apparatus for working on successive segments of the material and including a working table, carriage means supported to traverse the table in one coordinate direction for moving an instrument in working relation to sheet material spread on the table, sheet material shifting means for moving the material in the one coordinate direction to position it relative to the table, and first drive means for driving the material shifting means, said method comprising the steps of coupling a rotary incremental encoder to the carriage means and to the material shifting means to generate output signals in response to movement of the carriage means relative to the material shifting means, moving the carriage means in the one coordinate direction, storing the output signals from the encoder in a register, and energizing the first drive means with the output signals accumulated in the register.

24. A method for precisely positioning sheet material as set forth in claim 23 wherein said apparatus includes a controller and second drive means for moving the carriage means in response to signals from the controller and said method includes the further steps of disconnecting said register from said first drive means when said material shifting means has traversed a predetermined distance in the one coordinate direction and thereafter accumulating further output signals from said register in a storage means, and feeding the accumulated output signals from the storage means to the controller.

25. A method for precisely positioning sheet material as set forth in claim 24 including the additional step of energizing said second drive means with the output signals received by the controller from the storage means.

26. A method for precisely positioning sheet material as set forth in claim 24 wherein said controller comprises a computer having absolute data for controlling the second drive means and said method includes the additional step of utilizing the output signals received by the computer from the storage means to shift the origin of the absolute data within said computer.

27. A method for precisely positioning sheet material in an apparatus for working on sheet material having a working table, instrument means for working on sheet material, carriage means supported to move in a first coordinate direction relative to the table for moving the instrument means in working relation to sheet material spread on the table, first drive means for moving the carriage means in the first coordinate direction, means for controlling said first drive means to control movement of said carriage means, material shifting means for moving the sheet material relative to the table and in the first coordinate direction, and second drive means for moving the material shifting means, the apparatus having a working mode wherein said carriage means moves in said first coordinate direction from a position of origin relative to the table and the material spread thereon in response to signals from the control means to move the instrument in working relation to the material and a material moving mode wherein the instrument is out of working relation to the sheet material and the material shifting means moves the sheet material in the first coordinate direction relative to the table, said method comprising the steps of detecting the movement of said carriage means in said first coordinate direction relative to the sheet material in returning to said position of origin, upon completion of said working mode, and energizing said second drive means in response to the detected movement of said carriage means relative to the sheet material to cause the sheet material shifting means to move the sheet material in said first coordinate direction and to a predetermined position relative to said position of origin.

28. A method for precisely positioning sheet material as set forth in claim 27 wherein the step detecting the movement of said carriage means is further characterized as measuring the movement of the carriage means in the one coordinate direction relative to the sheet material with an incremental encoder which generates output signals and storing the output signals from the encoder in a register and the step of energizing said second drive means is further characterized as energizing the second drive means with the output signals accumulated in the register.

29. In an apparatus for working on sheet material and having a working table, instrument means for working on sheet material, carriage means supported to move in a first coordinate direction relative to the table for moving the instrument means in working relation to sheet material spread on the table, first drive means for moving the carriage means in the first coordinate direction, means for controlling said first drive means to control movement of said carriage means, material shifting means for moving the sheet material relative to the table and in the first coordinate direction, and second drive means for moving the material shifting means, the apparatus having a working mode wherein said carriage means moves in said first coordinate direction relative to the table and the material spread thereon in response to signals from the control means to move the instrument in working relation to the material, and a material moving mode wherein the instrument is out of working relation to the sheet material and the material shifting means moves the sheet material in the first coordinate direction relative to the table, the improvement comprising sensing means connected with said carriage means and said material shifting means for detecting shifting movement of the sheet material relative to the carriage means during said material moving mode, and adjustable means in the means for controlling said first drive means and responsive to said sensing means for adjusting the movement of said carriage means in the first coordinate direction and relative to the sheet material during the working mode by the amount of shifting movement detected by the sensing means during the material moving mode.

30. In an apparatus for working on sheet material as set forth in claim 29 the further improvement wherein said sensing means comprises an incremental encoder and said apparatus includes a counter receiving output signals from said incremental encoder.

31. In an apparatus for working on sheet material as set forth in claim 30 the further improvement wherein said encoder comprises a shaft angle encoder having two count channels and responsive to the direction of shaft rotation and said counter comprises an up/down counter.

32. A method for precisely positioning on a work table successive segments of sheet material such as fabric or the like, said method comprising the steps of moving an instrument carriage in one coordinate direction relative to sheet material supported on the work table to move an instrument in working relation to one segment of the sheet material, measuring with a rotary encoder which generates an output signal relative to measured distance movement of the instrument carriage in the one coordinate direction relative to the sheet material, storing the output signals from the encoder in a register, and driving a material shifting means in the one coordinate direction with the output signals accumulated in the register to shift the material in the one coordinate direction.

33. The method as set forth in claim 3 wherein the step of moving an instrument carriage is further characterized as moving an instrument carriage in response to output signals from a controller and said method includes the further steps of interrupting the signals from the register to the material shifting means when the material shifting means has moved the sheet material a predetermined distance in the one coordinate direction and thereafter accumulating further output signals from the register in a storage means.

34. The method as set forth in claim 33 including the additional steps of feeding the accumulated output signals from the storage means to the controller, and driving the instrument carriage in the one coordinate direction in response to the output signals received by the controller from the storage means.

35. The method as set forth in claim 33 wherein said controller comprises a computer having absolute data for controlling movement of the instrument carriage in said one coordinate direction and said method includes the additional steps of feeding the accumulated output signals from the storage means to the controller, and shifting the origin of the absolute data within said controller in response to the output signals received by the controller from the storage means.

* * * * *

UNITED STATES PATENT AND TRADEMARK OFFICE

CERTIFICATE OF CORRECTION

PATENT NO. : 4,328,726

DATED : May 11, 1982

INVENTOR(S) : David R. Pearl

It is certified that error appears in the above-identified patent and that said Letters Patent are hereby corrected as shown below:

In Column 12, line 23, "11" should be --9--.

In Column 16, line 10, "3" should be --32--.

Signed and Sealed this

*First* Day of *March 1983*

[SEAL]

*Attest:*

GERALD J. MOSSINGHOFF

*Attesting Officer*

*Commissioner of Patents and Trademarks*